US010253524B2

(12) United States Patent
Schneider et al.

(10) Patent No.: US 10,253,524 B2
(45) Date of Patent: Apr. 9, 2019

(54) COMBINATION BRACKET AND RAIL FOR MOUNTING A DECK BOARD

(71) Applicant: BARRETTE OUTDOOR LIVING, INC., Middleburg Heights, OH (US)

(72) Inventors: Christopher Michael Schneider, Mays Landing, NJ (US); Wayne Elbert Dixon, Chuckey, TN (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 236 days.

(21) Appl. No.: 15/426,948

(22) Filed: Feb. 7, 2017

(65) Prior Publication Data

US 2017/0356216 A1 Dec. 14, 2017

Related U.S. Application Data

(60) Provisional application No. 62/348,526, filed on Jun. 10, 2016.

(51) Int. Cl.

| | |
|---|---|
| ***E04H 17/14*** | (2006.01) |
| ***E04H 12/22*** | (2006.01) |
| ***E04H 17/22*** | (2006.01) |

(52) U.S. Cl.

CPC ..... *E04H 17/1421* (2013.01); *E04H 12/2215* (2013.01); *E04H 12/2238* (2013.01); *E04H 17/1417* (2013.01); *E04H 17/22* (2013.01); *E04H 2017/1452* (2013.01)

(58) Field of Classification Search

CPC ..... E04H 17/00; E04H 17/14; E04H 17/1417; E04H 17/1421; E04H 17/143; E04H 17/1434; E04H 17/1439; E04H 17/1443

See application file for complete search history.

(56) References Cited

U.S. PATENT DOCUMENTS

| | | | | | |
|---|---|---|---|---|---|
| 358,461 | A * | 3/1887 | Lee | E04H 17/14 | 256/65.06 |
| 949,075 | A * | 2/1910 | Hulett | F16B 7/0446 | 256/65.06 |
| 2,608,386 | A * | 8/1952 | Hart | E04H 17/1434 | 248/219.4 |
| 4,114,861 | A * | 9/1978 | Long | E04H 17/1413 | 248/219.4 |
| 4,919,394 | A * | 4/1990 | Otte | E04F 11/1817 | 256/59 |

(Continued)

*Primary Examiner* — Daniel J Wiley

(74) *Attorney, Agent, or Firm* — John Maldjian; Maldjian Law Group LLC

(57) ABSTRACT

A fence assembly includes a post anchored to a solid surface. The assembly also includes a bracket mounted on a coupling surface of the post. The assembly further includes a rail secured to the bracket. The rail includes a core member. The core member further includes an upper surface, a lower surface opposite to the upper surface, and a pair of opposite lateral sides extending between the upper surface and the lower surface. The rail also includes a pair of flanges extending along the upper surface, each of the pair of flanges located on a corresponding opposite lateral side of the core member. The assembly also includes a deck board including a lower surface, wherein the upper surface of the core member of the rail and the pair of flanges of the rail are configured to support the lower surface of the deck board.

20 Claims, 14 Drawing Sheets

(56) References Cited

U.S. PATENT DOCUMENTS

| | | | | | |
|---|---|---|---|---|---|
| 5,547,169 | A * | 8/1996 | Russell | E04H 17/1443 | 256/59 |
| 5,967,498 | A * | 10/1999 | Junell | E04F 11/181 | 256/19 |
| 6,543,751 | B1 * | 4/2003 | Spruill | E04F 11/1817 | 256/65.04 |
| 6,948,704 | B2 * | 9/2005 | Forbis | E04F 11/1817 | 256/65.08 |
| 2008/0179581 | A1 * | 7/2008 | Mulgrew | E04H 17/1439 | 256/65.03 |
| 2010/0270525 | A1 * | 10/2010 | Erwin | E04F 11/1817 | 256/65.06 |
| 2010/0270526 | A1 * | 10/2010 | Erwin | E04H 17/1421 | 256/65.06 |

* cited by examiner

700

900

1000

1100

COMBINATION BRACKET AND RAIL FOR MOUNTING A DECK BOARD

CROSS-REFERENCE TO RELATED APPLICATIONS

This application claims the benefit of U.S. Provisional Application Ser. No. 62/348,526 filed on Jun. 10, 2016, the entire content of which is hereby incorporated by reference in its entirety.

BACKGROUND

Field of the Invention

Embodiments of the present invention, generally relate to fence assembly and methods, and in particular relate to a fence rail having flanges contoured to provide a flat mounting surface for a detachable rail topper or a deck board.

Background

Railing systems are used extensively for a variety of functional purposes, e.g., as fencing to secure people, animals, and land, and to prevent entry into a specified area. Railing systems also may have aesthetic purposes, e.g., on decks and around yards, terraces, and gardens, etc. Railing systems often include at least one horizontal rail affixed to at least one vertical post, and optionally a plurality of balusters.

Consumers often have a preference regarding aesthetic features, such as color of a rail or rail topper, apparent texture (e.g., matte, faux wood, etc.), shape, etc. Stocking all possible combinations of aesthetic features that a manufacturer offers may be expensive for a retailer. Furthermore, consumers may want to change the look and feel of an installed railing system. Replacing the railing system or major portions of it is costly, inconvenient and time consuming.

A traditional method to upgrade a railing system is to screw clips on top of a rail, then attach a regular deck board to the clips. However, clips by themselves on a rail have poor structural integrity, resulting in undesirable waving and bowing of the deck board. Exposed clips will not be aesthetically pleasing. Furthermore, usage of clips may cause an unappealing gap between the rail and the deck board.

SUMMARY

Embodiments in accordance with the present disclosure provide an apparatus to attach rigidly a deck board to a fence rail and a method of manufacturing the same. Embodiments provide a rail having an upper surface contoured to match a lower surface of the deck board. The contour may include flat (e.g., horizontally planar) portions. The upper surface of the fence rail may include flanges running along an upper portion and on opposite lateral sides of the fence rail. The flanges may be used to provide a surface to which fastening devices (e.g., mounting screws) may be used to fasten the rail to the deck board.

According to another aspect of the present disclosure, a railing system includes an elongated upper rail, an elongated lower rail, and a plurality of balusters extending between the elongated upper rail and the elongated lower rail. The elongated upper rail includes an upper surface, including flanges, contoured to match a lower surface of a deck board.

The deck board has an elongated central body having a rectangular top surface and a rectangular bottom surface.

Embodiments in accordance with the present invention are directed to a fence assembly. The assembly can include a post anchored to a solid surface. The post further includes a coupling surface. The assembly can also include a bracket mounted on the coupling surface of the post. The assembly can further include a rail secured to the bracket. The rail includes a core member. The core member further includes an upper surface, a lower surface opposite to the upper surface, wherein the lower surface is configured to be attached to a plurality of balusters, and a pair of opposite lateral sides extending between the upper surface and the lower surface. The rail also includes a pair of flanges extending along the upper surface. Further, each of the pair of flanges is located on a corresponding opposite lateral side of the core member. The assembly can also include a deck board including a lower surface, wherein the upper surface of the core member of the rail and the pair of flanges of the rail are configured to support the lower surface of the deck board. The assembly can also include a plurality of fasteners configured to fasten the deck board to the pair of flanges of the rail. Further, the plurality of fasteners is disposed underneath the deck board so that the plurality of fasteners is hidden when viewed from a top of the deck board.

Embodiments in accordance with the present invention further provide a fence assembly. The assembly can include a post anchored to a solid surface. The post includes a coupling surface. The assembly can also include an upper bracket mounted on the coupling surface of the post, and a lower bracket mounted on the coupling surface of the post and spaced apart from the upper bracket. The assembly can also include an upper rail secured to the upper bracket. The upper rail further includes a core member including an upper surface, a lower surface opposite to the upper surface; and a pair of opposite lateral sides extending between the upper surface and the lower surface. The upper rail further includes a pair of flanges extending along the upper surface, each of the pair of flanges located on a corresponding opposite lateral side of the core member. The assembly can also include a deck board including a lower surface, wherein the upper surface of the core member of the rail and the pair of flanges of the rail are configured to support a lower surface of the deck board. The assembly can also include a plurality of fasteners configured to fasten the deck board to the pair of flanges of the upper rail. Further, the plurality of fasteners is disposed underneath the deck board so that the plurality of fasteners is hidden when viewed from a top of the deck board. The assembly can also include a lower rail coupled to the lower bracket and a plurality of balusters disposed between and coupled to the upper rail and the lower rail.

Embodiments in accordance with the present invention further provide a method of manufacturing a fence assembling kit. The method can include providing a post configured to be anchored to a solid surface. The post includes a coupling surface. The method can also include providing a bracket configured to be mounted on the coupling surface of the post, the bracket including a pair of side walls defining a cavity therebetween. The method can also include providing a rail configured to be at least partially received within the cavity of the bracket. The rail includes a core member, the core member including an upper surface, a lower surface opposite to the upper surface, and a pair of opposite lateral sides extending between the upper surface and the lower surface. The rail further includes a pair of flanges extending along the upper surface. Further, each of the pair of flanges is located on a corresponding opposite lateral side of the core member. The pair of flanges are supported by the pair of side walls of the bracket. The method can also include providing a deck board disposed on the upper surface of the core member of the rail and the pair of flanges of the rail. The method can also include providing a plurality of mechanical fasteners configured to couple the deck board to the pair of flanges of the rail. Further, the plurality of fasteners is disposed underneath the deck board so that the plurality of fasteners is hidden when viewed from a top of the deck board.

The railing system, as disclosed by the present disclosure, advantageously may be combined with the traditional railing system to offer a completely different look to the railing. Multiple styles may be offered for sale by a retailer, without devoting separate bay space to each possible combination of rail and deck board topping. It may be retrofitted with existing railings purchased previously by customers.

The railing system, as disclosed by the present disclosure, may include an elongate rail with a pair of flanges located on opposite lateral sides of a core member of the rail, wherein the pair of flanges include apertures. The apertures in the pair of flanges may allow expansion or contraction of the rail that may occur with temperature change.

Embodiments of the present disclosure may provide a number of advantages depending on its particular configuration. It is an object of the present disclosure to provide a fence assembly, a fence kit, a method of manufacturing the fence kit and methods for assembling the fence assembly, that simplify an on-site assembly of a fence, enhance safety during the on-site assembly and improve the aesthetic appeal of the fence in the assembled state.

These and other advantages will be apparent from the present application of the embodiments described herein.

The preceding is a simplified summary to provide an understanding of some embodiments of the present disclosure. This summary is neither an extensive nor exhaustive overview of the present disclosure and its various embodiments. The summary presents selected concepts of the embodiments of the present disclosure in a simplified form as an introduction to the more detailed description presented below. As will be appreciated, other embodiments of the present disclosure are possible utilizing, alone or in combination, one or more of the features set forth above or described in detail below.

BRIEF DESCRIPTION OF THE DRAWINGS

The above and still further features and advantages of embodiments of the present disclosure will become apparent upon consideration of the following detailed description of embodiments thereof, especially when taken in conjunction with the accompanying drawings, and wherein.

Figure 1:
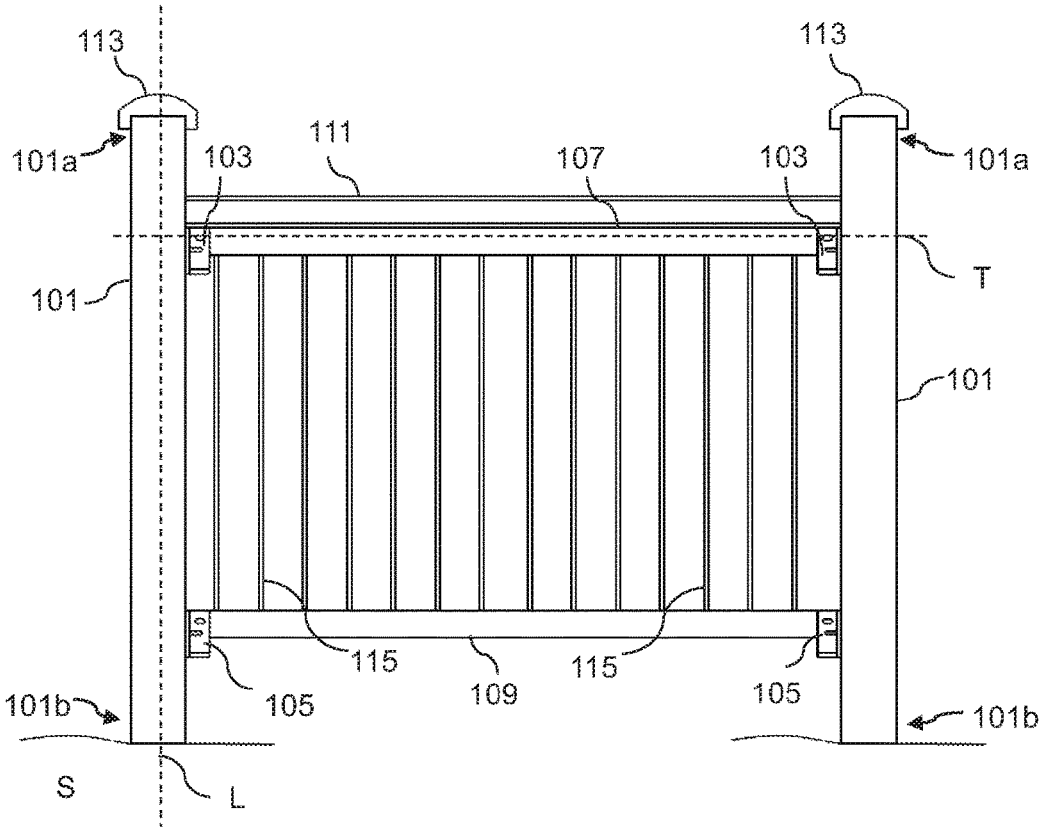
FIG. 1 illustrates a side view of a fence assembly, according to an embodiment of the present disclosure.

While embodiments of the present disclosure are described herein by way of example using several illustrative drawings, those skilled in the art will recognize the present disclosure is not limited to the embodiments or drawings described. It should be understood the drawings and the detailed description thereto are not intended to limit the present disclosure to the particular form disclosed, but to the contrary, the present disclosure is to cover all modification, equivalents and alternatives falling within the spirit and scope of embodiments of the present disclosure as recited in the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present disclosure will be described below in conjunction with exemplary fence assemblies. Embodiments of the present disclosure are not limited to any particular type of fence assembly. Those skilled in the art will recognize the disclosed techniques may be used in building an aesthetically pleasing fence.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" may be used interchangeably herein. It is also to be noted that the terms "comprising", "including", and "having" may be used interchangeably.

FIG. 1 illustrates a side view of a fence assembly 100, according to an embodiment of the present disclosure. The fence assembly 100 may be installed in an outdoor region, including, but not limited to, yards, lawns, gardens, outdoor decks, porches, and the like. The fence assembly 100 includes a pair of posts 101, a pair of upper brackets 103, a pair of lower brackets 105, an upper rail 107, a lower rail 109, a deck board 111 and a plurality of balusters 115. At least one of posts 101 and corresponding brackets 103, 105 may be replaced with a coupling to a solid structure (e.g., a wall of a building).

The pair of posts 101 may be anchored to a solid surface, such as a side of a building, or may be sunk into the ground for support. In an exemplary embodiment, the pair of posts 101 may be embedded partially within the ground such that each of the posts 101 is substantially stationary with respect to a ground surface "S". Further, each of the posts 101 may have a hollow elongate structure defining a longitudinal axis "L". Each of the posts 101 may further include a top longitudinal opening (not shown in FIG. 1), which is closed by a cap 113. Each of the posts 101 has a top end 101*a* and a bottom end 101*b*. The bottom end 101*b* may be embedded within the ground. Alternatively, each of the posts 101 may have a solid configuration.

The pair of upper brackets 103 and the pair of lower brackets 105 are mounted on a coupling surface (not shown in FIG. 1) of the posts 101. Each of the upper brackets 103 is positioned proximate to the top end 101*a* of the posts 101, while each of the lower brackets 105 is spaced apart from corresponding the upper brackets 103 and is positioned proximate to the bottom end 101*b*. Further, each of the upper brackets 103 and the lower brackets includes a cavity (not shown in FIG. 1) configured to at least partially receive the upper rail 107 and the lower rail 109, respectively. The pair of upper brackets 103 and the lower brackets 105 may be coupled to the coupling surface of the posts 101 via a plurality of mechanical fasteners, an adhesive, a mechanical joint or a combination thereof. Alternatively, each of the upper brackets 103 and the lower brackets 105 may be coupled to the posts 101 by various methods such as, but not limited to, welding, brazing, and the like.

The upper rail 107 is disposed between the pair of posts 101 and secured to the upper brackets 103, while the lower rail 109 is spaced apart from the upper rail 107 and secured to the lower brackets 105. The upper rail 107 and the lower rail 109 extend along a transverse axis "T" that is substantially perpendicular to the longitudinal axis "L". Further, the upper rail 107 may have a pair of flanges (not shown in FIG. 1) configured to support the deck board 111. The deck board 111 has an elongated central body having a rectangular top surface (not show in FIG. 1) and a rectangular bottom surface (not show in FIG. 1). The deck board 111 is configured to cover the upper rail 107 and the upper brackets 103.

The balusters 115 are disposed between and coupled to the upper rail 107 and the lower rail 109. In some embodiments, the balusters 115 are coupled to the upper rail 107 and the lower rail 109 through friction fit within apertures (not shown in FIG. 1) provided in the upper rail 107 and the lower rail 109. In an alternate embodiment, one or more U-channels (not shown) may also be provided adjacent to the posts 101 in order to retain the balusters 115 between the post 101. The balusters 115 may have a closed top, an open top or a lattice top. Each of the balusters 115 may have substantially flat hollow structures. Further, the balusters 115 may have a suitable cross-sectional shape of, e.g., rectangular, square, polygonal, oval, circular, elliptical, and so forth. The balusters 115 may abut with each other or a clearance may be provided between them. Moreover, the balusters 115 may be directly coupled to the upper rail 107 and the lower rail 109. In an alternate embodiment, an adapter rail may also be coupled to the upper rail 107 and/or the lower rail 109 in order to support the balusters 115.

Figure 2:
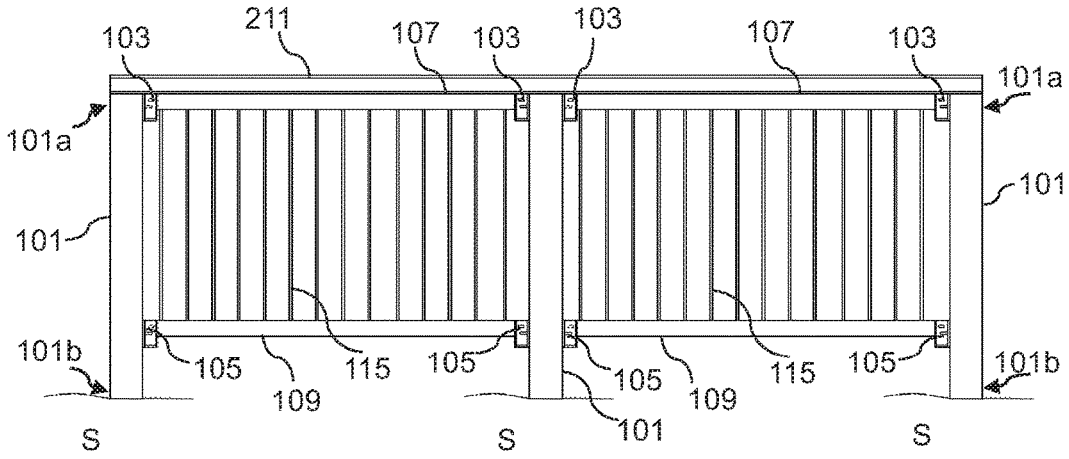
FIG. 2 illustrates a side view of a fence assembly, according to another embodiment of the present disclosure.

FIG. 2 illustrates a side view of a fence assembly 200, according to another embodiment of the present disclosure. The fence assembly 200, as illustrated in FIG. 2, includes three posts 101, two pairs of upper brackets 103, two pairs of lower brackets 105, and two upper rails 107, and two lower rails 109. Further, each of the upper brackets 103 may be located toward the top end 101*a* of the posts 101, such that a top edge (not shown in FIG. 1) of the upper bracket 103 is substantially flush with the top end 101*a* of the corresponding posts 101. Such a placement of the upper brackets 103 may allow for an elongated deck board 211 to be installed, such that a single deck board 211 may span a distance great than a distance between adjacent posts 101.

The components of the fence assembly 100 and 200 may be part of a fence kit that is assembled on-site. The fence assembly 100, 200, as described above, are purely exemplary in nature, and various alternatives may be envisioned within the scope of the present disclosure.

Figure 3:
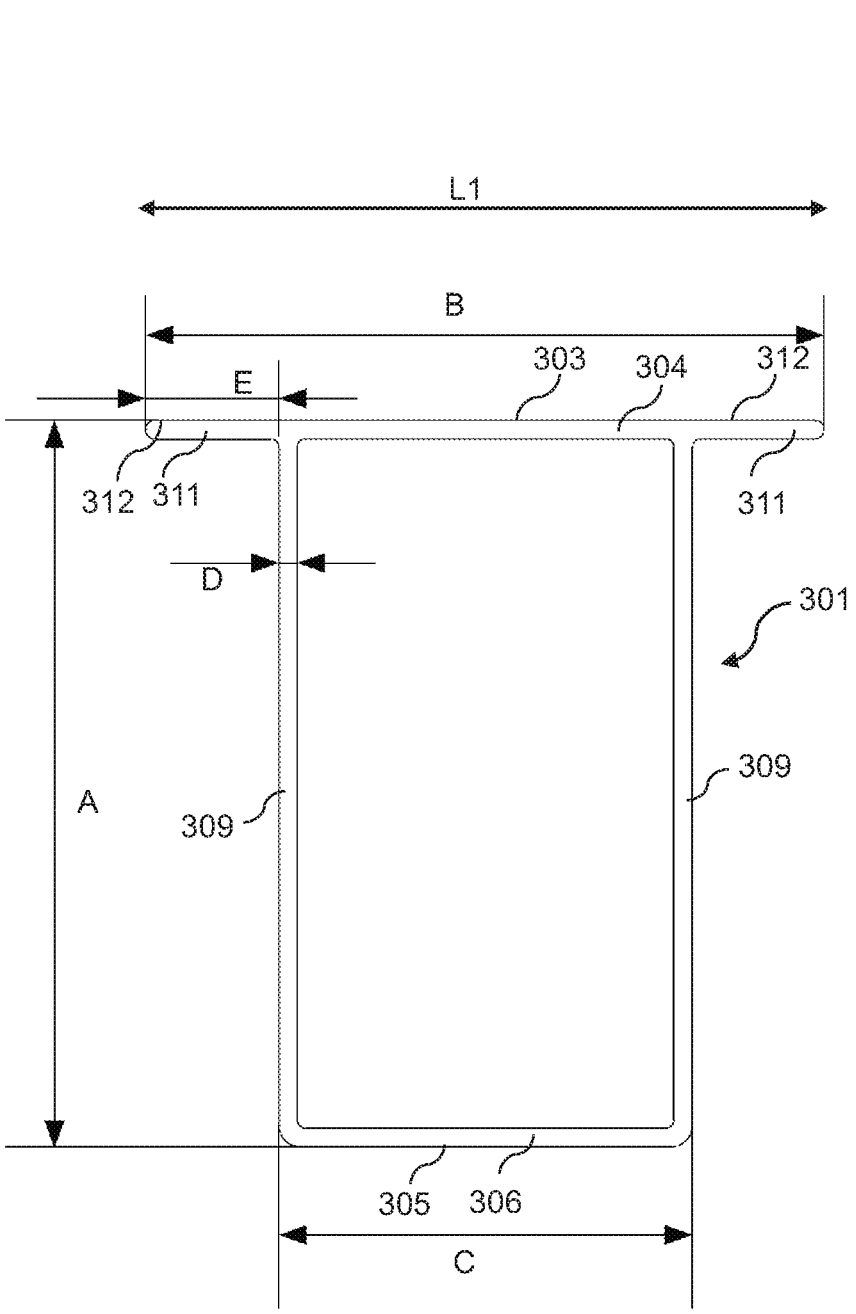
FIG. 3 illustrates a cross-sectional view of a rail, in accordance with an embodiment of the present disclosure.

FIG. 3 illustrates a cross-sectional view of the upper rail 107 (hereinafter referred to as "the rail 107"), in accordance with an embodiment of the present disclosure. The rail 107 has a major longitudinal axis that extends perpendicular to the plane of FIG. 3. A lateral direction "L1" is across a horizontal width of the rail 107, perpendicular to the major longitudinal axis. The rail 107 includes an elongated core member 301, which is a rigid load-bearing component and provides strength to the rail 107. The core member 301 may be formed of a material that distributes loads along the length of the rail 107, for example, vinyl, plastic, wood, aluminum or other metal, etc. The core member 301 may be manufactured by an extrusion process. The core member 301 of the rail 107 may further include an upper surface 303 configured to support the deck board 111 (as shown in FIG. 1). The core member 301 of the rail 107 also includes a lower surface 305 opposite to the upper surface 303 and a pair of opposite lateral sides 309 (interchangeably referred to as "the lateral sides 309") extending between the upper surface 303 and the lower surface 305. The lower surface 305 is attached to the plurality of balusters 115 (as shown in FIG. 1). Surface 303 is the upper surface of upper wall 304 of the core member 301, while surface 305 is the lower surface of lower wall 306 of the core member 301. In the illustrated embodiment, the upper surface 303 and the lower surface 305 are substantially parallel to each other, while the pair of lateral walls 309 are substantially parallel to each other. In some embodiments, the upper surface 303, the lower surface 305 and the pair of lateral sides 309 together enclose an elongated hollow structure.

The rail 107 may further include a pair of flanges 311, located on the opposite lateral sides 309 of the core member 301, along the upper surface 303 of the core member 301. Each of the pair of flanges 311 includes an upper surface 312 for supporting the deck board 111. In an embodiment, the upper surface 312 of the flanges 311 and the upper surface 303 of the core member 301 are contoured to match a lower surface (not shown in FIG. 3) of the deck board 111 (shown in FIG. 1). The core member 301 may have a shape to provide a suitable cross-section to the rail 107. The core member 301 of the rail 107 may have substantially any shape, e.g., rectangular, square, polygonal, oval, circular, elliptical, and so forth. In the illustrated embodiment, the core member 301 may have a height "A" and a width "B" including the pair of flanges 311. The core member 301 may have a width "C" and, if hollow, may have a wall thickness of "D". Each of the pair of flanges 311 may have a width "E", such that B=C+2×E. In some embodiments, A may be about 3.50 inches, B may be about 3.25 inches, C may be about 2.00 inches, D may be about 0.09 inches, and E may be about 0.625 inches. Other combinations of dimensions (including ratios of dimensions) for the rail 107 may be usable, in order to satisfy functional and/or aesthetic requirements, such as to provide a minimum load-bearing capacity, or to provide a minimum surface area for a deck board to couple to, or to provide a desired amount of privacy, or to provide a maximum opening size in order to keep an animal inside of or outside of an enclosure, and so forth. In an alternate embodiment, the core member 301 of the rail 107 may have a solid configuration with the width "C".

Those skilled in the art will appreciate that in other embodiments of the present disclosure, rail 107 may have a different shape.

Figure 4:
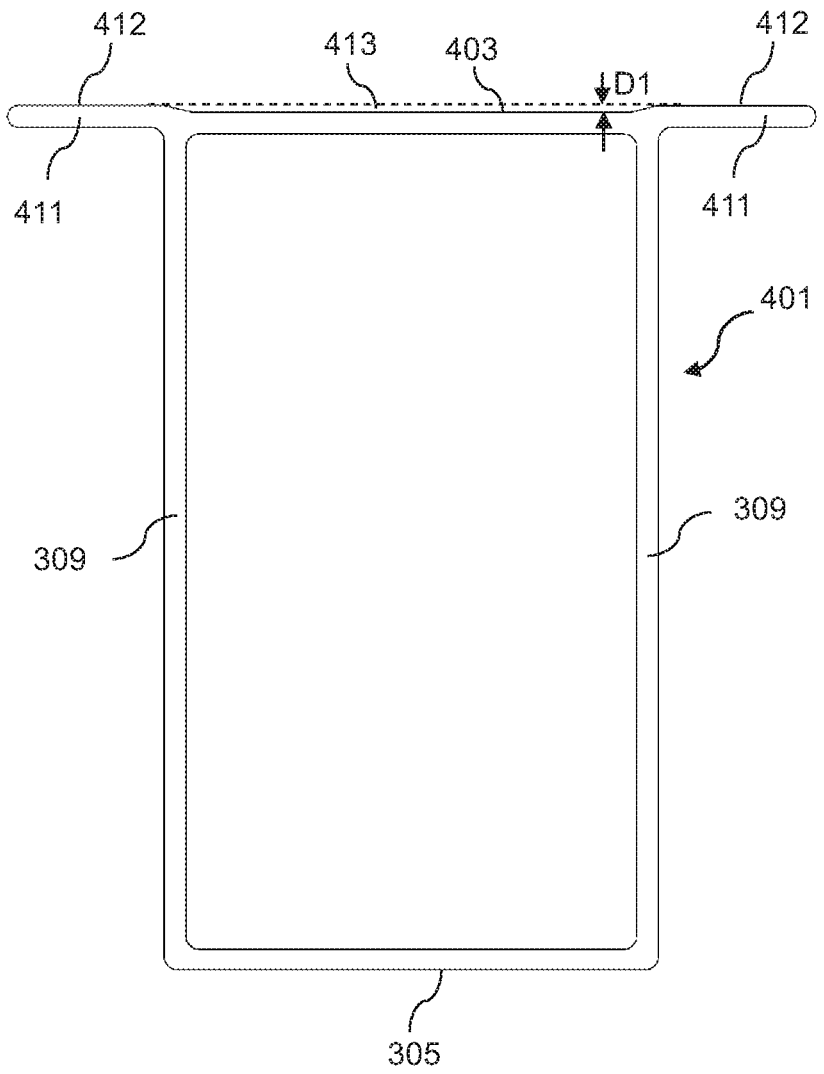
FIG. 4 illustrates a cross-sectional view of a rail, in accordance with another embodiment of the present disclosure.

FIG. 4 illustrates a cross-sectional view of an upper rail 407 (hereinafter referred to as "the rail 407"), in accordance with another embodiment of the present disclosure. Various components of the rail 407 are similar to corresponding components of the rail 107, and are therefore assigned with corresponding reference numbers. However, the rail 407 includes a pair of flanges 411 that are slightly elevated above an upper surface 403 of a core member 401, thereby creating a shallow pocket 413. In some embodiments, a depth "D1" of the shallow pocket 413 may be about 0.05 inches. The presence of the shallow pocket 413 may improve the manufacturability of the rail 407 when the rail 407 is manufactured by an extrusion process. The deck board 111 (as shown in FIG. 1) may be attached to the rail 407 by coupling the deck board 111 to upper surfaces 412 of the flanges 411. A gap formed between the deck board 111 (as shown in FIG. 1) and the rail 407 in the vicinity of the shallow pocket 413 is not visible once the deck board 111 is attached.

Various components, as shown in FIG. 3 and FIG. 4, may be common to both the upper rail 107 and the lower rail 109. However, the lower rail 109 may not include a pair of flanges.

Figure 5:
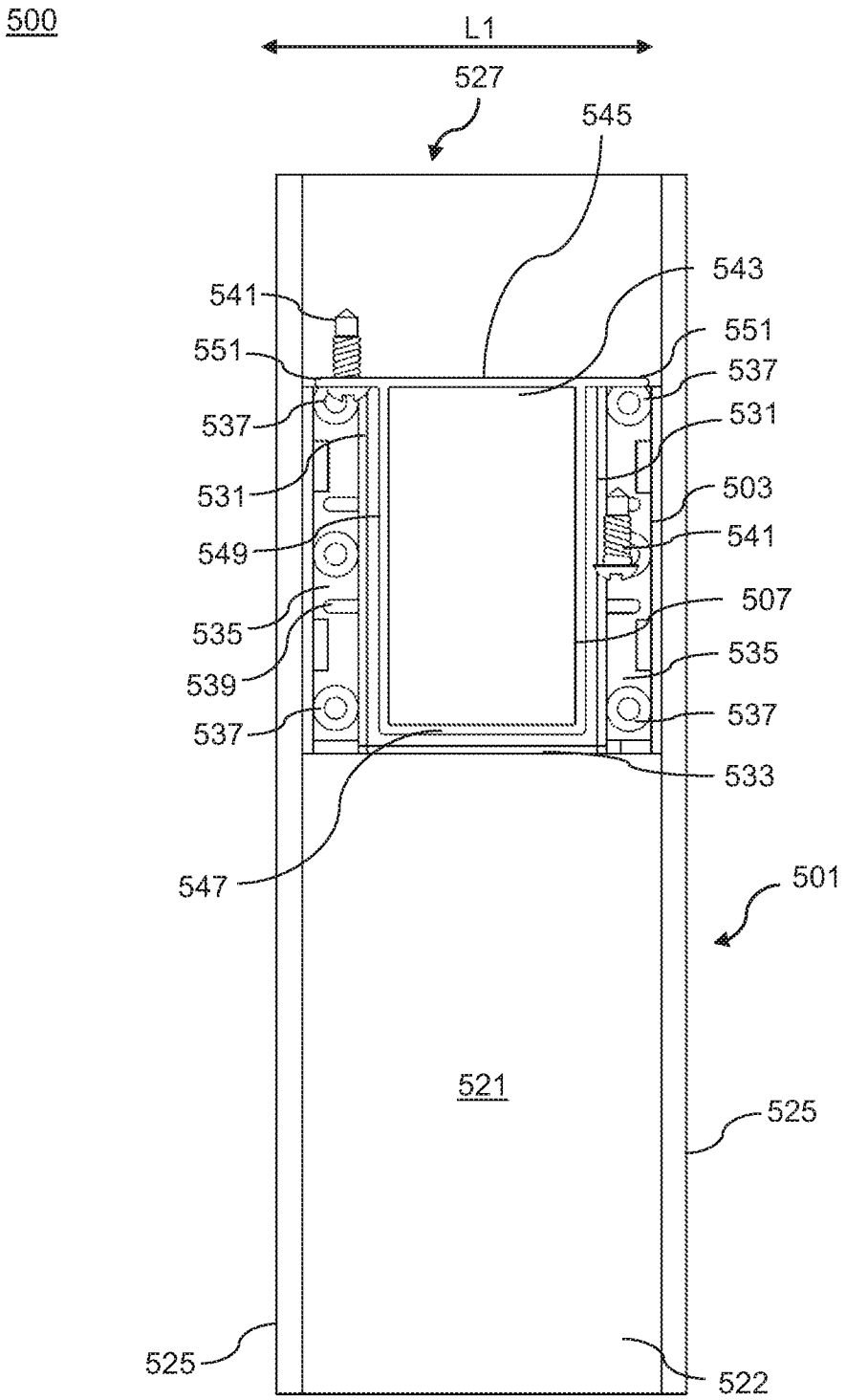
FIG. 5 illustrates a left end plan view of an assembly, according to an embodiment of the present disclosure.

FIG. 5 illustrates a left end plan view of an assembly 500. The deck board 111, the balusters 115 and the cap 113 are not shown in FIG. 5 for illustrative purposes. The lateral direction "L1" is depicted horizontally in FIG. 5, and the longitudinal direction is perpendicular to the plane of FIG. 5. The fence assembly 500 includes a post 501, the post 501 includes a coupling surface 521 having a front wall 522, a back surface (not shown in FIG. 5) opposite to the coupling surface 521, and having a back wall (not shown), and a pair of side walls 525 extending between the coupling surface 521 and the back surface. The deck board 111 is configured to be flush with the coupling surface 521 of the post 501. The front wall 522, the back wall, and the pair of side walls 525 collectively surround a longitudinal opening 527 covered by the cap 113 (as shown in FIG. 1). The front wall 522, the back wall, and the pair of side walls 525 may have a shape to provide a suitable cross-section to the post 501. The post 501 may have a variety of cross-section shapes, for example, but not limited to, rectangular, square, polygonal, oval, circular, elliptical, and so forth.

Further, a bracket 503 is mounted on the coupling surface 521 of the post 501. The bracket 503 may include a pair of pair of side walls 531 disposed parallel to each other and a bottom wall 533 extending between the pair of side walls 531. The pair of side walls 531 and the bottom wall 533 surround a cavity (not shown in FIG. 5) configured to receive at least partially a rail 507 therein. In an alternative embodiment, the side walls 531 may surround the cavity therebetween, while the bottom wall 533 may be absent. Further, each of the pair of side walls 531 includes a pair of projections 535 extending substantially perpendicular to the lateral direction "L1". The pair of projections 535 provides a supporting surface to the bracket 503 in order to couple to the coupling surfacing 521 of post 501. In some embodiments, each of the projections 535 includes multiple apertures (i.e., holes) 537 configured to receive mechanical fasteners in order to couple the bracket 503 to the post 501. Further, the bracket 503 is open from the top end in order to support flanges 551 of the rail 507. In an alternate embodiment, the bracket 503 may be coupled to the post 501 by a suitable fastening method, e.g., welding, adhesive and so forth. Moreover, the bracket 503 may also include multiple ribs 539 to provide rigidity to the bracket 501.

The rail 507 includes an elongated core member 543. The core member 543 of the rail 507 may further include an upper surface 545 configured to support the deck board 111 (shown in FIG. 1). The core member 543 of the rail 507 also includes a lower surface 547 opposite to the upper surface 545 of the rail 507 and a pair of opposite lateral sides 549 extending between the upper surface 545 and the lower surface 547. Further, the upper surface 545 of the core member 543 of the rail 507 is configured to be flush with the coupling surface 521 of the post 501. The rail 507 may further include a pair of flanges 551, located preferably on the opposite lateral sides 549 of the core member 543, along the upper surface 545 of the core member 543.

The assembly 500 also includes a plurality of mechanical fasteners 541 configured to fasten the deck board to the pair of flanges 551 of the rail 507. In an alternate embodiment, an adhesive material may be used to provide more strength to the joint between the deck board 111 and the rail 507.

Figure 6A:
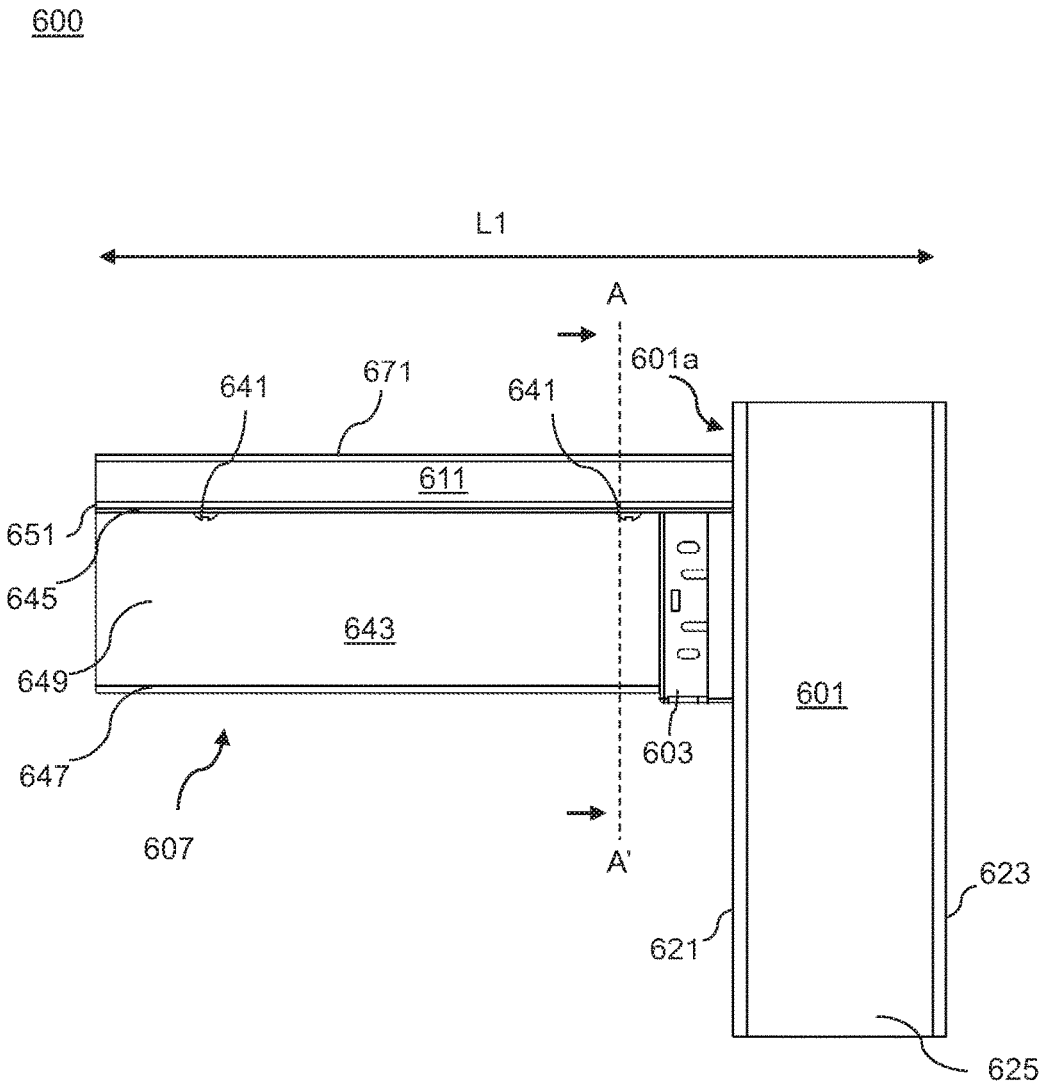
FIG. 6A illustrates a side plan view of an assembly, according to an embodiment of the present disclosure.
Figure 6B:
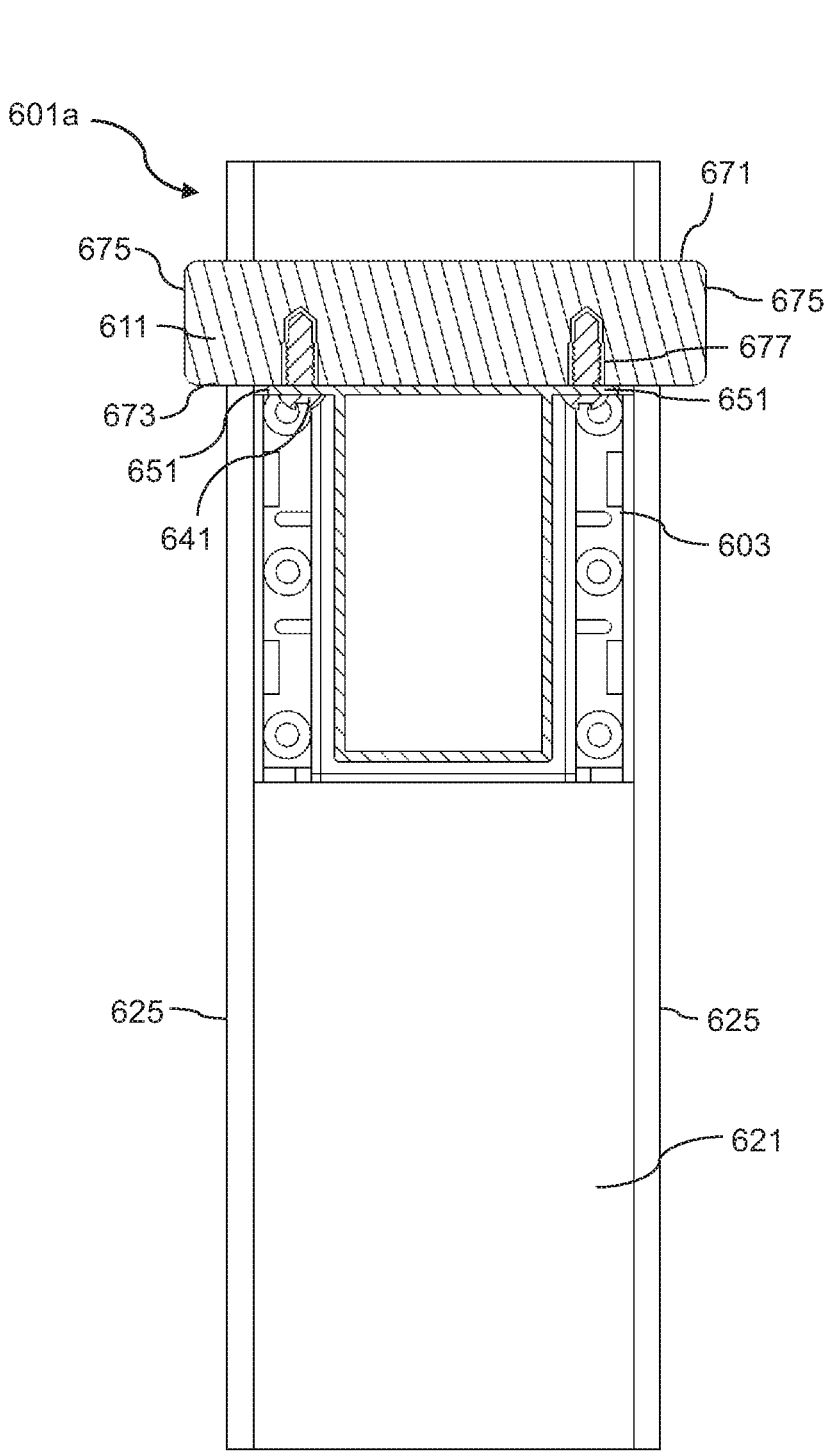
FIG. 6B and FIG. 6C are sectional views of the assembly taken along a line A-A' of FIG. 6A, according to embodiments of the present disclosure.
Figure 6C:
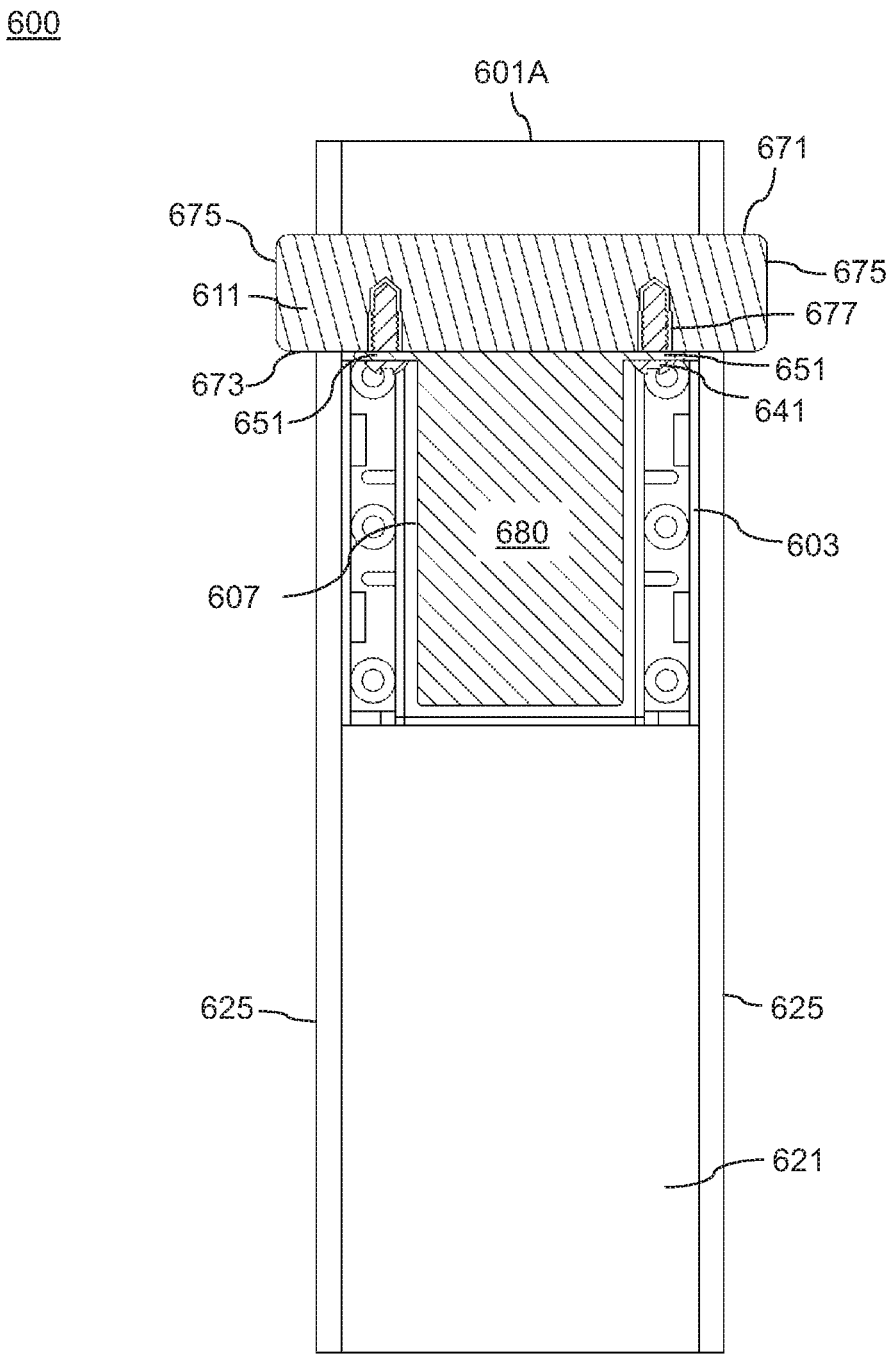

FIG. 6A illustrates a side plan view of an assembly 600, including a rail 607, a deck board 611 and a post 601 in an assembled configuration. FIGS. 6B and 6C are sectional views of the assembly 600 taken along a line A-A' of FIG. 6A. The longitudinal direction "L1" is depicted horizontally in FIG. 6A, and the lateral direction is perpendicular to the plane of FIG. 6A. Referring to FIGS. 6A and 6B, the post 601 is typically anchored to a solid object, such as a side of a building, or may be sunk into the ground for support. The post 601 includes a coupling surface 621, a back surface 623 opposite to the coupling surface 621, and a pair of side walls 625 extending between the coupling surface 621 and the back surface 623. Further, a bracket 603 is mounted on the coupling surface 621 of the post 601. The bracket 603 is positioned proximate to a top end 601*a* of the post 601. A rail 607 is coupled to the post 601 by use of the bracket 603. The rail 607 includes an elongated core member 643. The core member 643 of the rail 607 may further include an upper surface 645 that supports a deck board 611. The core member 643 of the rail 607 also include a lower surface 647 opposite to the upper surface 645 of the rail 607 and a pair of opposite lateral sides 649 extending between the upper surface 645 and the lower surface 647. The rail 607 may further include a pair of flanges 651, located preferably on the opposite lateral sides 649 of the core member 643, along the upper surface 645 of the core member 643.

Referring to FIG. 6B, the deck board 611 may be fastened to the pair of flanges 651 by use of a plurality of mechanical fasteners 641. In various embodiments, the mechanical fasteners 641 may be self-tapping screws, bolts, and so forth. The deck board 611 may have an elongated central body that includes a top surface 671, a lower surface 673 opposite to the top surface 671, and a pair of lateral sides 675 extending between the top surface 671 and the rectangular surface 673. Each of the top surface 671 and the lower surface 673 may be rectangular. The elongated central body may have a suitable cross-sectional shape, for example, but not limited to, rectangular, square, polygonal, oval, circular, elliptical, and so forth. Further, the lower surface 673 may include a plurality of cavities 677 configured to receive at least partially the plurality of mechanical fasteners 641. The cavities 677 may extend from the lower surface 673 into the elongated central body substantially parallel to the pair of lateral sides 675. In an embodiment, the upper surface 645 of the core member 643 and the pair of flanges 651 of the rail 607 are contoured to match the lower surface 673 of the deck board 611. Therefore, the deck board 611 may be supported easily by the core member 643 and the pair of flanges 651 of the rail 607.

FIG. 6C is a sectional view of the assembly 600 taken along the line A-A', in accordance with another embodiment of the present disclosure. While various components of the rail 607, as illustrated in FIG. 6C, are similar to those illustrated in FIGS. 6A and 6B, a core member 680, of the rail 607, may have a solid configuration in FIG. 6C. The solid configuration of core member 680 may provide more strength to the fence assembly 600.

Figure 7:
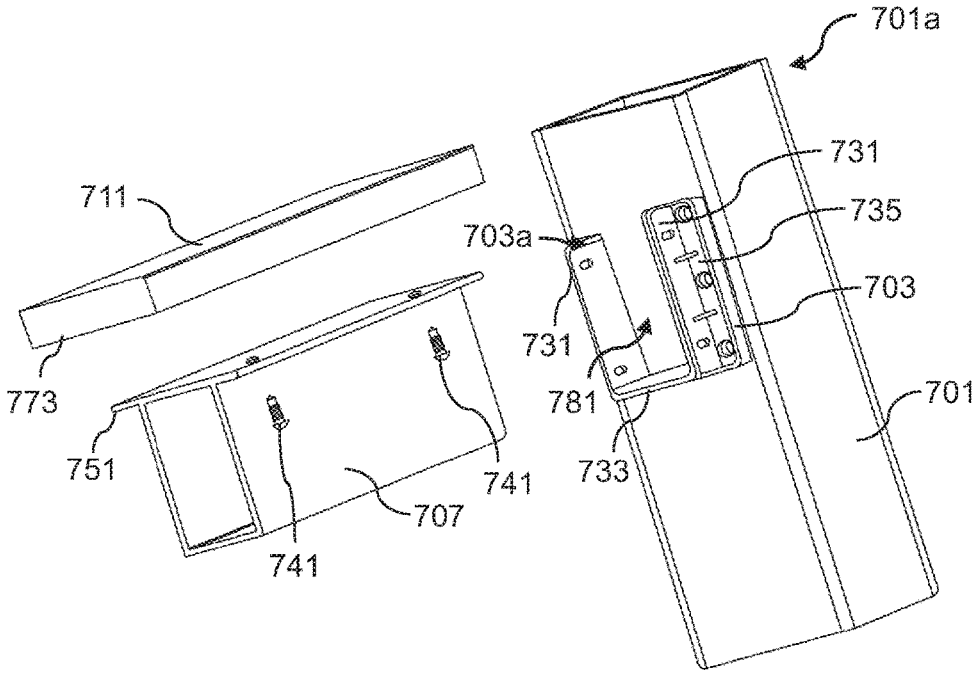
FIG. 7 illustrates an exploded oblique view of an assembly, in accordance with an embodiment of the present disclosure.

FIG. 7 illustrates an exploded oblique view of an assembly 700, in accordance with an embodiment of the present disclosure. Relative to FIGS. 6A to 6C, FIG. 7 illustrates, with more clarity, a cavity surrounded by a bracket to couple a rail to a post.

As illustrated in FIG. 7, a bracket 703 is mounted on a post 701. The bracket 703 may be coupled to the post 701 by various fastening methods such as, but not limited to mechanical fasteners, adhesive or a combination thereof. The bracket 703 may include a pair of lateral walls 731 disposed parallel to each other and a bottom wall 733 extending between the pair of lateral walls 731. The pair of lateral walls 731 and the bottom wall 733 together surround a cavity 781 configured to at least partially received a rail 707 therein. Further, each of the pair of lateral walls 731 includes a pair of projections 735 extending perpendicular to each of the lateral walls 731. The projections 735 provide a supporting surface to the bracket 703 in order to couple the bracket 703 to the post 701. Further, the bracket 703 is open at the top edge 703*a* for supporting flanges 751 of the rail 707. The rail 707 may be inserted within the cavity 781 by sliding the rail 707 towards the post 701.

The post 701 further includes a longitudinal opening 701*a* that is configured to be covered by the cap 113 (shown in FIG. 1).

Further, the rail 707 is secured to bracket 703, by various methods, for example, by fasteners, adhesives, friction fit, and so forth. Further, a deck board 711 is coupled to the rail 707 using a plurality of mechanical fasteners 741 coming from underneath the deck board 741, such that fasteners 741 may be hidden from a top or elevated point of view once the assembly 700 is in an assembled state.

Figure 8:
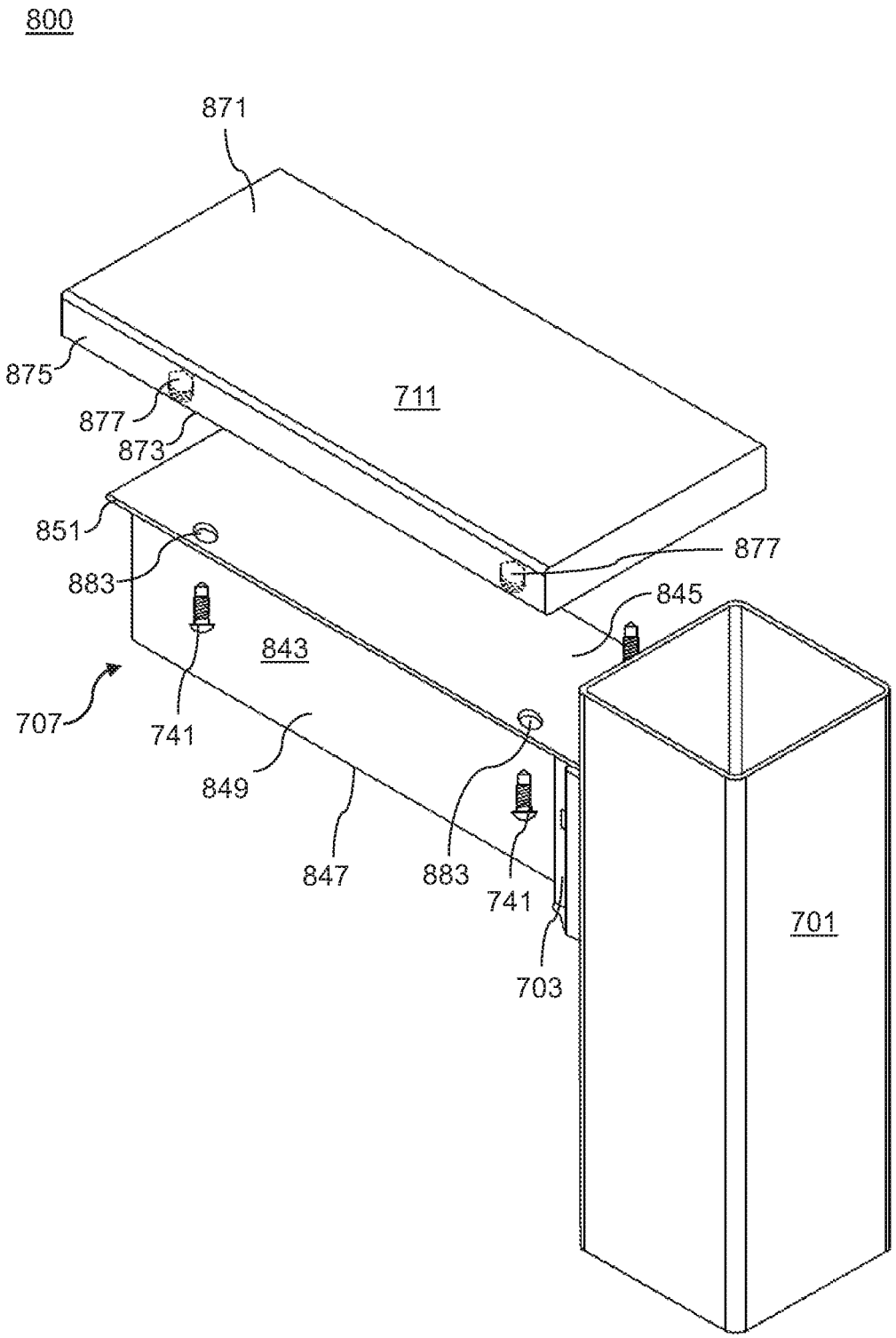
FIG. 8 illustrates a partially exploded oblique view of an assembly, in accordance with an embodiment of the present disclosure.

FIG. 8 illustrates a partially exploded oblique view of an assembly 800, in accordance with an embodiment of the present disclosure. FIG. 8 illustrates the mounting of a deck board on a top of a rail. Components of the assembly 800 that are similar to corresponding components of the assembly 700 have been assigned similar reference numbers.

As illustrated in FIG. 8, the rail 707 is mounted on the post 701 through the bracket 703. The rail 707 may include an elongated core member 843, a pair of flanges 851 and an upper surface 845. The core member 843 of the rail 707 may further include an upper surface 845 that supports the deck board 711. The core member 843 of the rail 707 also include a lower surface (not shown in FIG. 8) opposite to the upper surface 845 of the rail 707 and a pair of lateral sides 849 extending between the upper surface 845 and the lower surface. The rail 707 may further include a pair of flanges 851, located on the opposite lateral sides 849 of the core member 843, along the upper surface 845 of the core member 843.

Further, each of flanges 851 includes a plurality of apertures 883 configured to receive the plurality of mechanical fasteners 741. Mechanical fasteners 741 secure the deck board 711 to the rail 707.

The deck board 711 may have an elongated central body that include a top surface 871, a lower surface 873 opposite to the upper surface 871, and a pair of lateral sides 875 extending between the upper surface 871 and the lower surface 873. The elongated central body may have a suitable cross-sectional shape, for example, but not limited to, rectangular, square, polygonal, oval, circular, elliptical, and so forth. Further, the lower surface 873 may include a plurality of cavities 877 configured to receive at least partially the plurality of mechanical fasteners 741. The cavities 877 may extend from the lower surface 873 into the elongated central body substantially parallel to the pair of lateral sides 875.

Figure 9:
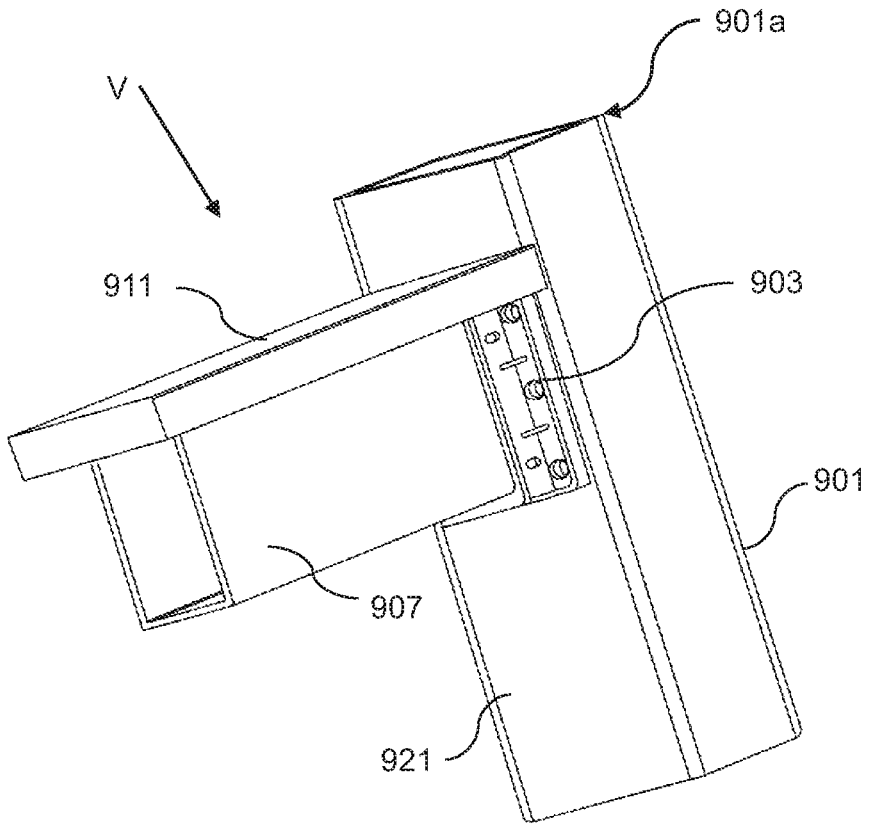
FIG. 9 illustrates an oblique view of an assembly, in accordance with an embodiment of the present disclosure.

FIG. 9 illustrates an oblique view of a fence assembly 900, in accordance with an embodiment of the present disclosure. The assembly 900 includes a post 901 that may be secured to a ground surface and substantially stationary with respect to the ground surface. Further, the post 901 may include a coupling surface 921.

As illustrated in FIG. 9, a bracket 903 is mounted on the coupling surface 921 of the post 901. Further a rail 907 is secured to the bracket 903 by various methods, such as, friction fit, adhesives, mechanical fasteners or a combination thereof. Moreover, a deck board 911 is disposed on the rail 907 that covers both the rail 907 and the bracket 903. As illustrated in FIG. 9, the deck board 911 is secured to the rail 907 using a plurality of mechanical fasteners coming from underneath the deck board 911, such that fasteners are hidden from a top or elevated point of view (indicated by an arrow "V").

Figure 10:
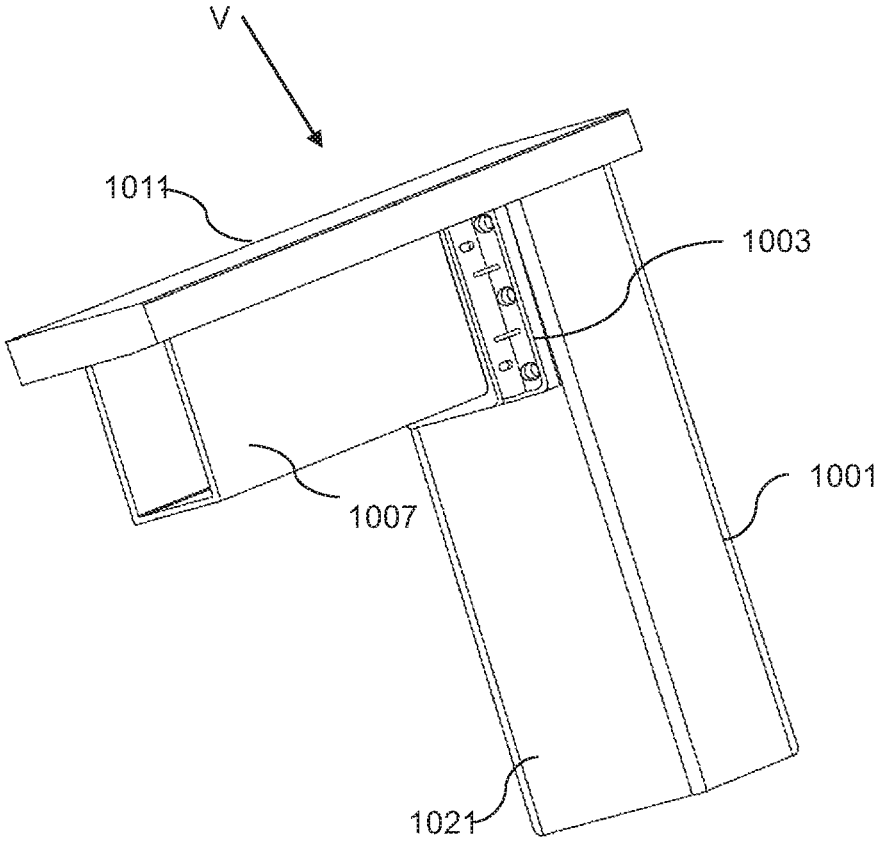
FIG. 10 illustrates an oblique view of an assembly, in accordance with another embodiment of the present disclosure.

FIG. 10 illustrates an oblique view of a fence assembly 1000, in accordance with an embodiment of the present disclosure. The upper brackets 1003 is located at the top of the post 1001 such that a top edge (not shown in FIG. 10) of the bracket 1003 is substantially flush with the top edge (not shown in FIG. 10) of the post 1001. Such a placement of the brackets 1003 may allow for an elongated deck board 1011 to be installed, such that a single deck board 1011 may cover the top of multiple such posts 1001 and rails 1007.

Figure 11A:
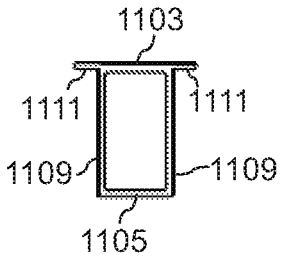
FIG. 11A illustrates an end view of an upper rail, in accordance with an exemplary embodiment of the present disclosure.
Figure 11B:
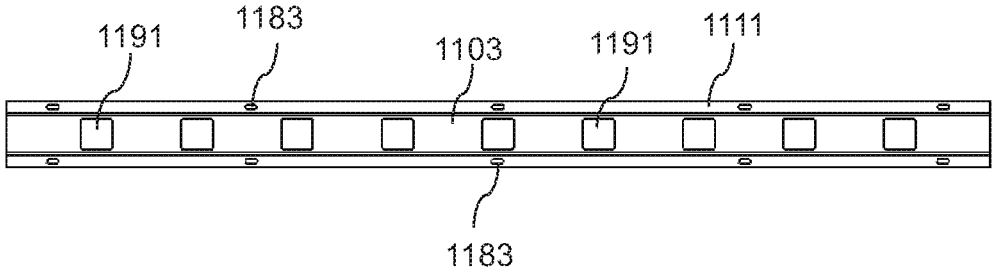
FIG. 11B illustrates a bottom view of an upper rail, in accordance with an exemplary embodiment of the present disclosure.

FIG. 11A and FIG. 11B illustrate an end view and a bottom view of an upper rail 1100, according to an exemplary embodiment of the present disclosure. Various components of upper rail 1100 are similar to upper rail 107 (as shown in FIG. 3), therefore components of upper rail 1100 have been assigned with corresponding reference numbers as that of upper rail 107. As shown in FIG. 11B, upper rail 1100 includes a plurality of apertures 1183 on an upper surface 1111 of upper rail 1100. Moreover, each of the flanges 1111 of upper rail 1100 may include a plurality of apertures 1183 configured to receive a plurality of mechanical fasteners such as, but not limited to, screws. In an embodiment, the apertures 1183 are equally distributed along a length of the rail 1100. The apertures 1183 are provided to allow the contraction or expansion of upper rail 1100 during a temperature change, thereby minimizing or preventing damage to upper rail 1100. The apertures 1183 may have a suitable shape such as, but not limited to, rectangular, circular, oval and so forth. The apertures 1191 provided on the lower surface 1105 of upper rail 1100 may be configured to receive a plurality of balusters (not shown in FIG. 11).

FIGS. 1, 3, 5, 6A, 6B, 7, 8, 9, 11A and 11B illustrate various views of the same assembly, in accordance with the present disclosure.

Figure 12:
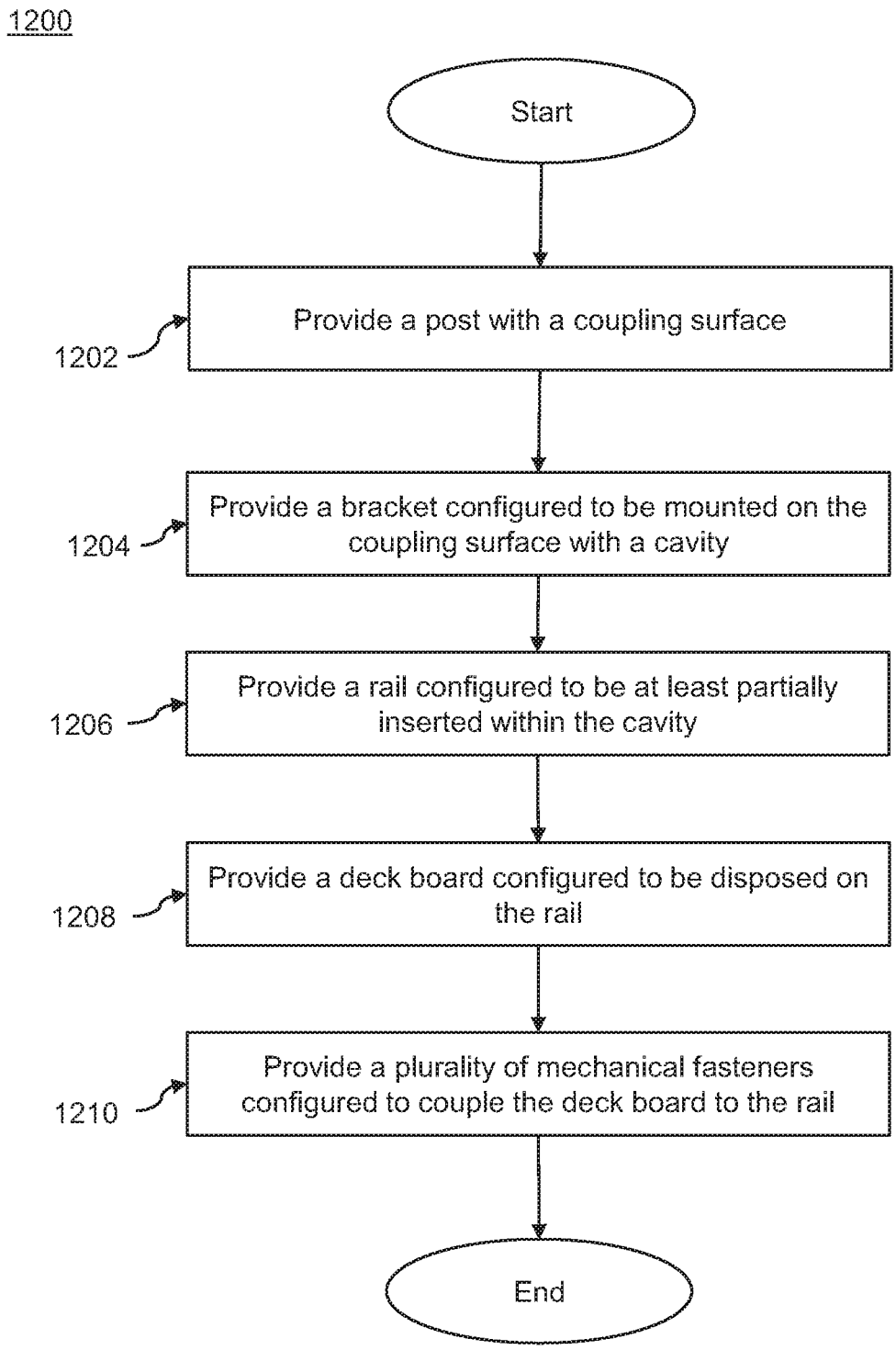
FIG. 12 illustrates a method of manufacturing a fence assembly, in accordance with an embodiment of the present disclosure.

FIG. 12 is a flowchart of an exemplary method 1200 of manufacturing the fence kit in accordance with an embodiment of the disclosed subject matter. This flowchart is merely provided for exemplary purposes, and embodiments are intended to include or otherwise cover methods or procedures for manufacturing the fence kit. The method of manufacturing 1200 is in accordance with the above described embodiments, therefore corresponding reference numbering has been used to describe the method 1200.

At step 1202, the method 1200 includes providing the post 101 configured to be anchored to a solid surface. In an exemplary embodiment, the post 101 may be embedded partially within the ground such that the posts 101 is substantially stationary with respect to the ground surface "S". Further, the post 101 may have a hollow elongate structure defining a longitudinal axis "L". The fence assembly 500 illustrates a post 101, the post 101 including a coupling surface 521 (shown in FIG. 5), a back surface 623 (shown in FIG. 6A), opposite to the coupling surface 521, and a pair of side walls 525 extending between the coupling surface 521 and the back surface. The coupling surface 521, the back surface 623, and the pair of side walls 521 collectively surround a longitudinal opening 527 covered by the cap 113 (as shown in FIG. 1). The coupling surface 521, the back surface 623, and the pair of side walls 525 may have a shape to provide a suitable cross-section to the post 101. The post 101 may have a cross-sectional shape of, e.g., rectangular, square, polygonal, oval, circular, elliptical, and so forth. The post 101 may be formed by various manufacturing methods, such as molding, casting, machining, extrusion or a combination thereof. The walls of the post 101 may be integrally formed or may be manufactured separately and then assembled together. Alternatively, the posts 101 may have a solid configuration.

At step 1204, the method 1200 includes providing the upper brackets 103 and the lower brackets 105 (shown in FIG. 1). The upper brackets 103 and the lower bracket 105 are mounted on the coupling surface 521 of the posts 101. Each of the upper brackets 103 is positioned proximate to the top end 101*a* of the posts 101, while each of the lower brackets 105 is spaced apart from the corresponding upper brackets 103 and is positioned proximate to the bottom end 101*b*. Further, each of the upper brackets 103 and the lower brackets 105 delimit a cavity 781 (shown in FIG. 7) configured to at least partially receive the upper rail 107 and the lower rail 109, respectively. The pair of upper brackets 103 and the pair of lower brackets 105 may be coupled to the coupling surface of the posts 101 via a plurality of mechanical fasteners, an adhesive or a combination thereof. Alternatively, each of the upper brackets 103 and the lower brackets 105 may be coupled to the posts 101 by various methods such as, but not limited to, welding, brazing, and so on.

At step 1206, the method includes providing upper rail 107 configured to be at least partially received within the cavity 781. Upper rail 107 includes an elongated core member 301 (shown in FIG. 3), which is a rigid load-bearing component and provides strength to upper rail 107. The core member 301 may be formed of a material that distributes loads along the length of upper rail 107, for example, vinyl, plastic, wood, aluminum or other metal, etc. The core member 301 may be manufactured by an extrusion process. The core member 301 of upper rail 107 may further include an upper surface 303 configured to support the deck board 111 (as shown in FIG. 1). The core member 301 of upper rail 107 also includes a lower surface 305 opposite to the upper surface of the 303 and a pair of opposite lateral sides 309 extending between the upper surface 303 and the lower surface 305 (shown in FIG. 3). In the illustrated embodiment, the upper surface 303 and the lower surface 305 are substantially parallel to each other, while the pair of opposite lateral walls 309 are substantially parallel to each other. In some embodiments, the upper surface 303, the lower surface 305 and the pair of opposite lateral sides 309 together enclose an elongated hollow structure.

Upper rail 107 may further include the pair of flanges 311 (shown in FIG. 3), located on the opposite lateral sides 309 of the core member 301, along the upper surface 303 of the core member 301. The upper surface 303, the lower surface 305 and the pair of lateral walls 309 provide a suitable cross-section shape to upper rail 107

At step 1208, the method 1200 includes providing the deck board 911 (shown in FIG. 9) on the upper surface of the core member 301 of upper rail 107 and the pair of flanges 311. The deck board 911 is secured to the rail 907 using a plurality of mechanical fasteners coming from underneath the deck board 911, such that fasteners are hidden from a top or elevated point of view. The deck board 911 may have an elongated central body that includes a top surface 871, a lower surface 873 opposite to the upper surface 871, and a pair of lateral sides 875 extending between the upper surface 871 and the lower surface 873 (shown in FIG. 8). The elongated central body may have a suitable cross-sectional shape of, e.g., rectangular, square, polygonal, oval, circular, elliptical, and so forth.

Further, the lower surface 873 may include a plurality of cavities 877 configured to receive at least partially the plurality of mechanical fasteners 741. The cavities 877 may extend from the lower surface 873 into the elongated central body substantially parallel to the pair of lateral sides 875. Next at step 1210, the method 1200 includes providing the plurality of mechanical fasteners 741 configured to couple the deck board 911 to the pair of flanges 311 of upper rail 107, wherein the plurality of fasteners 741 is disposed underneath the deck board 911 so that the plurality of fasteners 741 is hidden when viewed from the top of the deck board 911.

The assemblies, as disclosed by the present disclosure, advantageously may be combined or retrofitted with an existing fence. A user can easily replace deck boards of a fence using the combined rail and bracket assemblies of the present disclosure. Therefore, the user can install deck boards as per his or her preferences. Further, the flanges of the rail enable mechanical fasteners to be received from underneath the deck board at a lower surface so that the mechanical fasteners are not visible from above. The deck board also fully covers the rail and the bracket. Therefore, an aesthetic appeal of the fence is enhanced.

Although the disclosure has been described with reference to exemplary embodiments, it is not limited thereto. Those skilled in the art will appreciate that numerous changes and modifications may be made to the preferred embodiments of the disclosure and that such changes and modifications may be made without departing from the true spirit of the disclosure. It is therefore intended that the appended claims be construed to cover all such equivalent variations as fall within the true spirit and scope of the disclosure.

The exemplary embodiments of this present disclosure have been described in relation to fence assemblies. However, to avoid unnecessarily obscuring the present disclosure, the preceding description omits a number of known structures and devices. This omission is not to be construed as a limitation of the scope of the present disclosure. Specific details are set forth by use of the embodiments to provide an understanding of the present disclosure. It should however be appreciated that the present disclosure may be practiced in a variety of ways beyond the specific embodiments set forth herein.

A number of variations and modifications of the present disclosure may be used. It would be possible to provide for some features of the present disclosure without providing others.

The present disclosure, in various embodiments, configurations, and aspects, includes components, methods, processes, systems and/or apparatus substantially as depicted and described herein, including various embodiments, subcombinations, and subsets thereof. Those of skill in the art will understand how to make and use the present disclosure after understanding the present disclosure. The present disclosure, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present disclosure has been presented for purposes of illustration and description. It is not intended to limit the present disclosure to the form or forms disclosed herein. In the foregoing Detailed Description, for example, various features of the present disclosure are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present disclosure.

Moreover, though the description of the present disclosure has included description of one or more embodiments, configurations, or aspects and certain variations and modifications, other variations, combinations, and modifications are within the scope of the present disclosure, e.g., as may be within the skill and knowledge of those in the art, after understanding the present disclosure. The scope of the invention includes alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A fence assembly comprising:
- a post anchored to a solid surface, the post comprising a coupling surface;
- a bracket mounted on the coupling surface of the post;
- a rail secured to the bracket, the rail comprising:
  - a core member, the core member comprising:
    - an upper surface;
    - a lower surface opposite to the upper surface, wherein the lower surface is configured to be attached to a plurality of balusters; and
    - a pair of opposite lateral sides extending between the upper surface and the lower surface; and
  - a pair of flanges extending along the upper surface, each of the pair of flanges located on a corresponding opposite lateral side of the core member;
- a deck board comprising a lower surface, wherein the upper surface of the core member of the rail and the pair of flanges of the rail are configured to support the lower surface of the deck board; and
- a plurality of fasteners configured to fasten the deck board to the pair of flanges of the rail, wherein the plurality of fasteners is disposed underneath the deck board so that the plurality of fasteners is hidden when viewed from a top of the deck board.

2. The fence assembly of claim 1, wherein said flanges comprise a plurality of apertures to receive the plurality of fasteners.

3. The fence assembly of claim 1, wherein the upper surface of the core member of the rail is configured to be flush with the coupling surface of the post.

4. The fence assembly of claim 1, wherein the bracket is configured to be flush with a top edge of the post, and wherein the deck board is configured to be supported by the top edge of the post.

5. The fence assembly of claim 1, wherein the deck board is configured to be flush with the coupling surface of the post.

6. The fence assembly of claim 1, wherein the core member of the rail comprises an aperture in the upper surface of the core member.

7. The fence assembly of claim 1, wherein the bracket is configured to support the pair of flanges of the rail.

8. The fence assembly of claim 1, wherein each of the pair of the flanges is elevated above the upper surface of the core member.

9. The fence assembly of claim 1, wherein the upper surface of the core member and the pair of flanges are contoured to match the lower surface of deck board.

10. A fence assembly comprising:
- a post anchored to a solid surface, the post comprising a coupling surface;
- an upper bracket mounted on the coupling surface of the post;
- a lower bracket mounted on the coupling surface of the post and spaced apart from the upper bracket;
- an upper rail secured to the upper bracket, the upper rail comprising:
  - a core member, the core member comprising:
    - an upper surface;
    - a lower surface opposite to the upper surface; and
    - a pair of opposite lateral sides extending between the upper surface and the lower surface; and
  - a pair of flanges extending along the upper surface, each of the pair of flanges located on a corresponding opposite lateral side of the core member;
- a deck board comprising a lower surface, wherein the upper surface of the core member of the rail and the pair of flanges of the rail are configured to support a lower surface of the deck board;

a plurality of fasteners configured to fasten the deck board to the pair of flanges of the upper rail, wherein the plurality of fasteners is disposed underneath the deck board so that the plurality of fasteners is hidden when viewed from a top of the deck board;

a lower rail coupled to the lower bracket; and a plurality of balusters disposed between and coupled to the upper rail and the lower rail.

11. The fence assembly of claim 10, wherein said flanges comprise a plurality of apertures to receive the plurality of fasteners.

12. The fence assembly of claim 10, wherein the upper surface of the core member of the upper rail is configured to be flush with the coupling surface of the post.

13. The fence assembly of claim 10, wherein the upper bracket is configured to be flush with a top edge of the post, and wherein the deck board is configured to be supported by the top edge of the post.

14. The fence assembly of claim 10, wherein the deck board is configured to be flush with the coupling surface of the post.

15. The fence assembly of claim 10, wherein the core member of the upper rail comprises an aperture in the upper surface of the core member.

16. The fence assembly of claim 10, wherein the upper bracket is configured to support the pair of flanges of the upper rail.

17. The fence assembly of claim 10, wherein each of the pair of the flanges is elevated above the upper surface of the core member.

18. The fence assembly of claim 10, wherein the upper surface of the core member and the pair of flanges are contoured to match the lower surface of deck board.

19. A method of manufacturing a fence assembly kit, the method comprising:

providing a post configured to be anchored to a solid surface, the post comprising a coupling surface;

providing a bracket configured to be mounted on the coupling surface of the post, the bracket comprising a pair of side walls defining a cavity therebetween;

providing a rail configured to be at least partially received within the cavity of the bracket, the rail comprising:

a core member, the core member comprising:

an upper surface;

a lower surface opposite to the upper surface; and a pair of opposite lateral sides extending between the upper surface and the lower surface; and a pair of flanges extending along the upper surface, each of the pair of flanges located on a corresponding opposite lateral side of the core member; wherein the pair of flanges are supported by the pair of side walls of the bracket;

providing a deck board configured to be disposed on the upper surface of the core member of the rail and the pair of flanges of the rail; and providing a plurality of mechanical fasteners configured to couple the deck board to the pair of flanges of the rail, wherein the plurality of fasteners is disposed underneath the deck board so that the plurality of fasteners is hidden when viewed from a top of the deck board.

20. The method of claim 19, further comprising the step of coupling a plurality of balusters to the lower surface of the core member of the rail.

* * * * *